US006638039B1

(12) United States Patent
Saxton

(10) Patent No.: US 6,638,039 B1
(45) Date of Patent: Oct. 28, 2003

(54) DEVICE FOR REMOVING WATER FROM A PIPE

(76) Inventor: Wesley C. Saxton, 4200 Timberbrook Dr. #2433, San Antonio, TX (US) 78238

( * ) Notice: Subject to any disclaimer, the term of this patent is extended or adjusted under 35 U.S.C. 154(b) by 62 days.

(21) Appl. No.: 10/014,207

(22) Filed: Nov. 9, 2001

(51) Int. Cl.[7] ..... F04B 39/10
(52) U.S. Cl. ..... 417/569; 417/571
(58) Field of Search ..... 417/569, 571, 417/545

(56) References Cited

U.S. PATENT DOCUMENTS 1,556,426 A * 10/1925 Coop ..... 210/416.3
2,044,594 A 6/1936 Schofield
2,059,785 A 11/1936 Gaik
D170,387 S 9/1953 Russell
3,391,645 A * 7/1968 Koza ..... 417/565
5,239,708 A 8/1993 Irwin
5,244,365 A * 9/1993 Catcher ..... 417/569
5,522,094 A 6/1996 Balazs
5,927,957 A 7/1999 Kennedy et al.
6,422,434 B1 * 7/2002 Lammond Wass et al. . 222/571

* cited by examiner

*Primary Examiner*—Charles G. Freay

(57) ABSTRACT

A device for removing water from a pipe for removing water from pipes and the like such that the pipes may be worked on by a plumber includes a housing having a first chamber and a second chamber. A first and a second opening extend into the first chamber. A third opening extends between the first and second chambers. A fourth opening extends into the second chamber. An inlet pipe is fluidly coupled to the second opening. An outlet pipe is fluidly coupled to the fourth opening. A first valve is positioned in the second opening. The first valve is a one-way valve such that fluid may enter the first chamber from the inlet pipe through the second opening. A pump means draws water into the first chamber through the inlet pipe and expelling the water from the first chamber into the second chamber.

10 Claims, 2 Drawing Sheets

DEVICE FOR REMOVING WATER FROM A PIPE

BACKGROUND OF THE INVENTION

1. Field of the Invention

The present invention relates to water pump devices and more particularly pertains to a new device for removing water from a pipe for removing water from pipes and the like such that the pipes may be worked on by a plumber.

2. Description of the Prior Art

The use of water pump devices is known in the prior art. U.S. Pat. No. 5,927,957 describes a device for removing water with a pump which has a common inlet and outlet pipe. Another type of water pump device is U.S. Pat. No. 5,522,094 which uses a pump to force water into a pipe for clearing a clogged pipe.

While these devices fulfill their respective, particular objectives and requirements, the need remains for a device that removes potable water in an efficient manner from pipes or a toilet.

SUMMARY OF THE INVENTION

The present invention meets the needs presented above by providing a hand pump which has an inlet pipe for drawing water into the pump and an outlet pipe for expelling the water out of the pump.

Still yet another object of the present invention is to provide a new device for removing water from a pipe that has an inlet pipe having a decreasing diameter for attaching to a plurality of pipe.

To this, the present invention generally comprises a housing having a top wall, a bottom wall and a peripheral wall extending between the top and bottom walls. The housing has a first chamber and a second chamber. A first opening and a second opening each extend into the first chamber. A third opening extends between the first and second chambers. A fourth opening extends into the second chamber. An inlet pipe is fluidly coupled to the second opening. An outlet pipe is fluidly coupled to the fourth opening. A first valve is positioned in the second opening. The first valve is a one-way valve such that fluid may enter the first chamber from the inlet pipe through the second opening. A pump means is positioned in the first chamber for drawing water into the first chamber through the inlet pipe and expelling the water from the first chamber into the second chamber such that the water may exit the housing through the outlet pipe.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
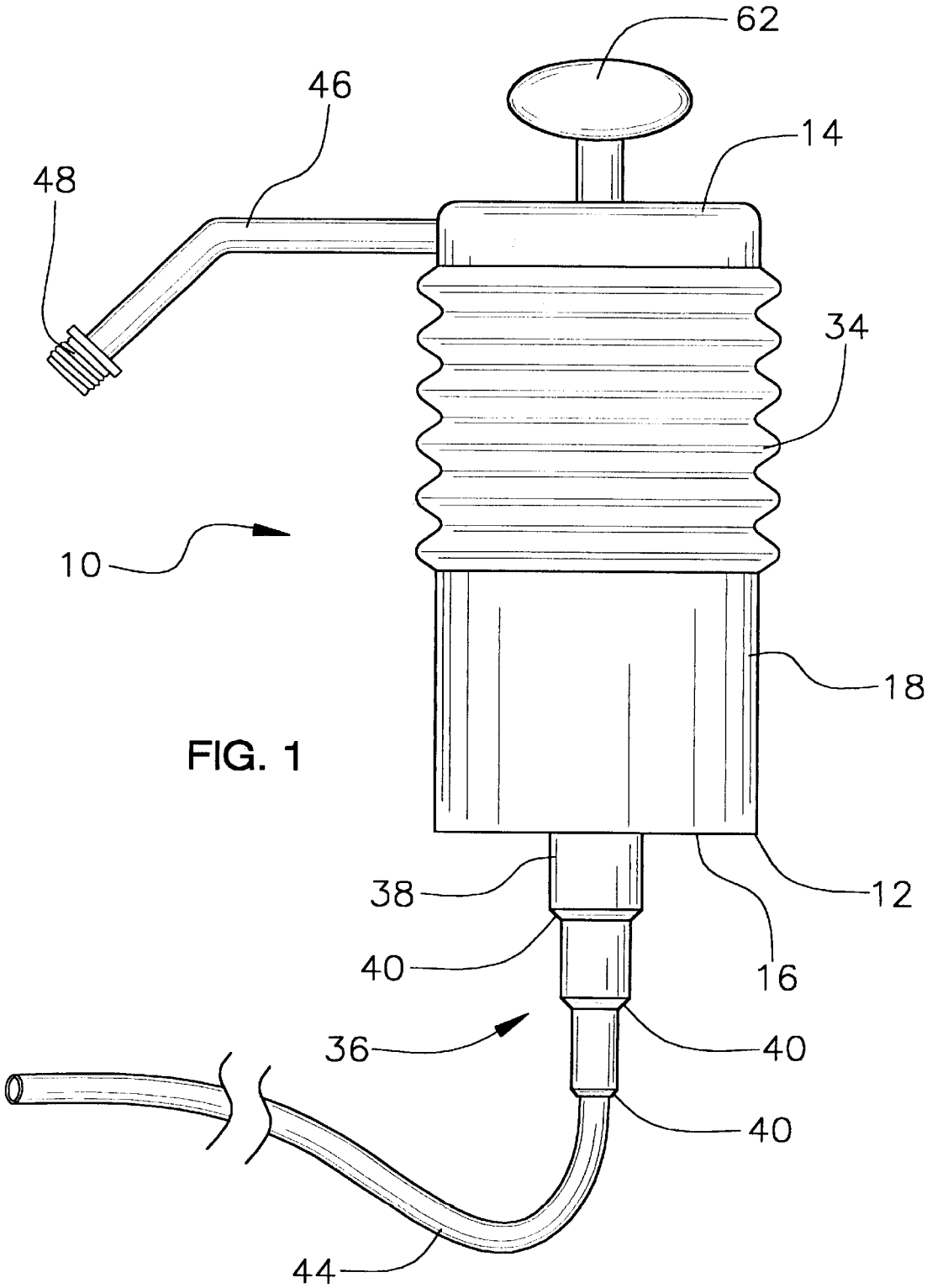
FIG. 1 is a schematic side view of a new device for removing water from a pipe according to the present invention.
Figure 2:
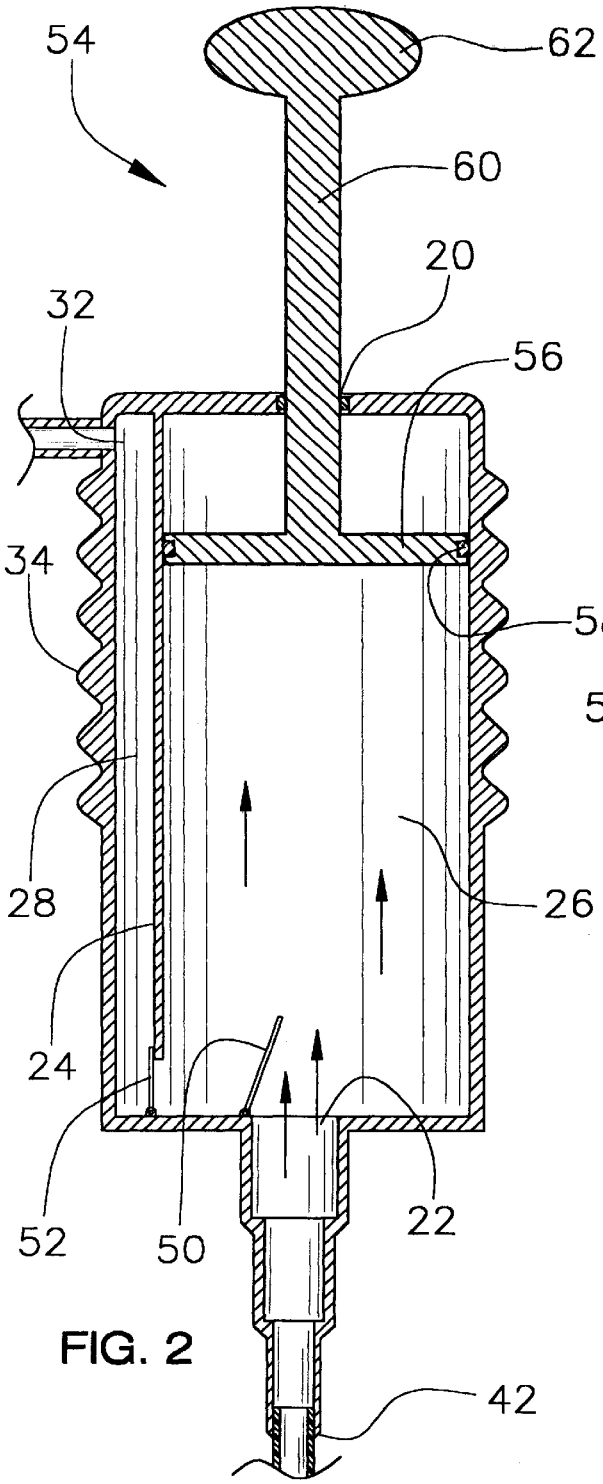
FIG. 2 is a schematic cross-sectional view of the present invention.
Figure 3:
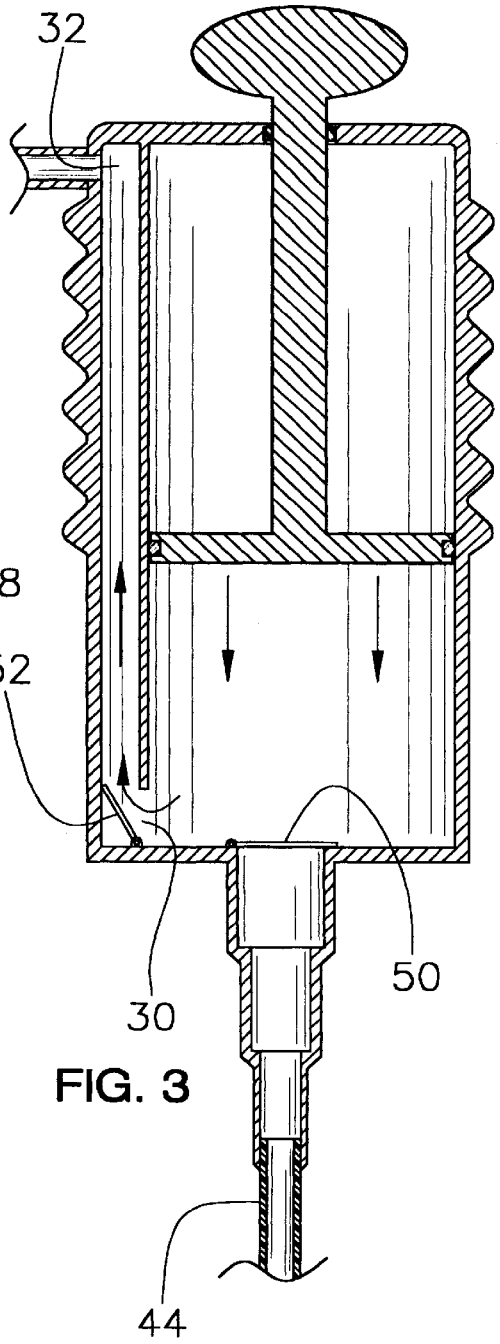
FIG. 3 is a schematic cross-sectional view of the present invention.

With reference now to the drawings, and in particular to FIGS. 1 through 3 thereof, a new device for removing water from a pipe embodying the principles and concepts of the present invention and generally designated by the reference numeral 10 will be described.

As best illustrated in FIGS. 1 through 3, the device for removing water from a pipe 10 generally comprises a housing 12 having a top wall 14, a bottom wall 16 and a peripheral wall 18 extending between the top 14 and bottom 16 walls. The top wall 14 has a first opening 20 therein. The bottom wall 16 has a second opening 22 therein. An intermediate wall 24 extends from the top wall 14 toward the bottom wall 16 such that a first 26 and second 28 chamber is defined in the housing 12. A third opening 30 is defined between a bottom edge of the intermediate wall 24 and the bottom wall 16. The first 20 and second 22 openings are positioned in the first chamber 26. A fourth opening 32 extends through the peripheral wall 18 and into the second chamber 28. The peripheral wall 18 has an outer surface having a plurality of gripping members 34 thereon extending around the housing.

An inlet pipe 36 is fluidly coupled to the second opening 22. The inlet pipe 36 has an outer surface 38 having a plurality of annular shoulders 40 therein such that a diameter of the inlet pipe 36 decreases from the bottom wall 16 to a free end 42 of the inlet pipe 36. A hose 44 extends into the free end 42 and is fluidly coupled to the inlet pipe 36.

An outlet pipe 46 is fluidly coupled to the fourth opening 32 and extends away from the housing 12. The outlet pipe 46 has a threaded end 48.

A first valve 50 is positioned in the second opening 22. The first valve 50 is a one-way valve such that-fluid may enter the first chamber 26 from the inlet pipe 36 through the second opening 22.

A second valve 52 is positioned in the third opening 30. The second valve 52 is a one-way valve such that fluid may enter the second chamber 28 from the first chamber 26 through the third opening 28.

A pump means 54 is positioned in the first chamber 26 for drawing water into the first chamber 26 through the inlet pipe 36 and expelling the water from the first chamber 26 into the second chamber 28 such that the water may exit the housing 12 through the outlet pipe 46. The pump 54 includes a plate 56 that is mounted in the first chamber 26 and orientated generally parallel to a plane of the top wall 14. A seal 58 extends around and is attached to a perimeter edge of the plate 56 for generally forming a seal with an inner surface of the peripheral wall 18 and the intermediate wall 24. A rod 60 extends through the first opening 20 and is attached to the plate 56. A handle 62 is attached to an upper end of the rod 6 0.

In use, the tube 44 is extended into a pipe. The inlet pipe 36 has a decreasing diameter to fit into various sized pipes.

The plate 56 is moved upward toward the top wall 14 for drawing water into the first chamber 26 from a pipe. The plate 56 may then be moved downward toward the bottom wall 16 such that the water is forced into the second chamber 28 and outward through the fourth opening 32. In this manner, water within a pipe, toilet or other item being repaired by a plumber, may be removed in an efficient manner.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pump device for removing water from pipes, said device comprising:

a housing having a top wall, a bottom wall and a peripheral wall extending between said top and bottom walls, said housing having a first chamber and a second chamber, a first opening and a second opening each extending into said first chamber, a third opening extending between said first and second chambers, a fourth opening extending into said second chamber;

an inlet pipe being fluidly coupled to said second opening;

an outlet pipe being fluidly coupled to said fourth opening;

a first valve being positioned in said second opening, said first valve being a one-way valve such that fluid may enter said first chamber from said inlet pipe through said second opening;

a pump means being positioned in said first chamber for drawing water into said first chamber through said inlet pipe and expelling the water from said first chamber into said second chamber such that the water may exit said housing through said outlet pipe; and wherein said inlet pipe has an outer surface having a plurality of annular shoulders therein such that a diameter of said inlet pipe decreases from said bottom wall to a free end of said inlet pipe.

2. The pump device as in claim 1, wherein said top wall having said first opening therein, said bottom wall having said second opening therein, an intermediate wall extending from said top wall toward said bottom wall such that said first and second chambers are defined, said third opening being defined between a bottom edge of said intermediate wall and the bottom wall, said fourth opening extending through said peripheral wall.

3. The pump device as in claim 1, wherein said peripheral wall has an outer surface having a plurality of gripping members thereon extending around said housing.

4. The pump device as in claim 1, further including a hose extending into said free end and being fluidly coupled to said inlet pipe.

5. The pump device as in claim 1, said outlet pipe having a threaded end.

6. The pump device as in claim 1, further including a second valve being positioned in said third opening, said second valve being a one-way valve such that fluid may enter said second chamber from said first chamber through said third opening.

7. The pump device as in claim 2, further including a second valve being positioned in said third opening, said second valve being a one-way valve such that fluid may enter said second chamber from said first chamber through said third opening.

8. The pump device as in claim 7, wherein said pump includes:

a plate being mounted in said first chamber and orientated generally parallel to a plane of said top wall, a seal extending around and being attached to a perimeter edge of said plate for generally forming a seal with an inner surface of said peripheral wall and said intermediate wall;

a rod extending through said first opening and being attached to said plate;

a handle being attached to an upper end of said rod; and wherein said plate is moved upward toward said top wall for drawing water into said first chamber such that said plate may be moved downward toward said bottom wall such that said water is forced into said second chamber and outward through said fourth opening.

9. The pump device as in claim 2, wherein said pump includes:

a plate being mounted in said first chamber and orientated generally parallel to a plane of said top wall, a seal extending around and being attached to a perimeter edge of said plate for generally forming a seal with an inner surface of said peripheral wall and said intermediate wall;

a rod extending through said first opening and being attached to said plate;

a handle being attached to an upper end of said rod; and wherein said plate is moved upward toward said top wall for drawing water into said first chamber such that said plate may be moved downward toward said bottom wall such that said water is forced into said second chamber and outward through said fourth opening.

10. A pump device for removing water from pipes, said device comprising:

a housing having a top wall, a bottom wall and a peripheral wall extending between said top and bottom walls, said top wall having a first opening therein, said bottom wall having a second opening therein, an intermediate wall extending from said top wall toward said bottom wall such that a first and second chamber being defined in said housing, a third opening being defined between a bottom edge of said intermediate wall and said bottom wall, said first and second openings being positioned in said first chamber, a fourth opening extending through said peripheral wall and into said second chamber, said peripheral wall having an outer surface having a plurality of gripping members thereon extending around said housing;

an inlet pipe being fluidly coupled to said second opening, said inlet pipe having an outer surface having a plurality of annular shoulders therein such that a diameter of said inlet pipe decreases from said bottom wall to a free end of said inlet pipe, a hose extending into said free end and being fluidly coupled to said inlet pipe;

an outlet pipe being fluidly coupled to said fourth opening and extending away from said housing, said outlet pipe having a threaded end;

a first valve being positioned in said second opening, said first valve being a one-way valve such that fluid may enter said first chamber from said inlet pipe through said second opening;

a second valve being positioned in said third opening, said second valve being a one-way valve such that fluid may enter said second chamber from said first chamber through said third opening;

a pump means being positioned in said first chamber for drawing water into said first chamber through said inlet pipe and expelling the water from said first chamber into said second chamber such that the water may exit said housing through said outlet pipe, said pump including;

a plate being mounted in said first chamber and orientated generally parallel to a plane of said top wall, a seal extending around and being attached to a perimeter edge of said plate for generally forming a seal with an inner surface of said peripheral wall and said intermediate wall;

a rod extending through said first opening and being attached to said plate;

a handle being attached to an upper end of said rod; and wherein said plate is moved upward toward said top wall for drawing water into said first chamber such that said plate may be moved downward toward said bottom wall such that said water is forced into said second chamber and outward through said fourth opening.

* * * * *